US007637073B2

(12) United States Patent
Elliott et al.

(10) Patent No.: US 7,637,073 B2
(45) Date of Patent: Dec. 29, 2009

(54) WALL STRUCTURE FOR PROTECTION FROM BALLISTIC PROJECTILES

(75) Inventors: A. Carleton Elliott, Newport Beach, CA (US); Allan J. Swartz, Gardnerville, NV (US); Gregory Kulpa, Tustin, CA (US)

(73) Assignee: Specialty Hardware L.P., Newport Beach, CA (US)

( * ) Notice: Subject to any disclaimer, the term of this patent is extended or adjusted under 35 U.S.C. 154(b) by 277 days.

(21) Appl. No.: 11/620,670

(22) Filed: Jan. 6, 2007

(65) Prior Publication Data

US 2008/0010932 A1 Jan. 17, 2008

Related U.S. Application Data

(60) Provisional application No. 60/766,286, filed on Jan. 8, 2006.

(51) Int. Cl.
*E04B 2/56* (2006.01)
*E04C 2/20* (2006.01)

(52) U.S. Cl. ..... 52/745.05; 52/506.04; 52/145; 52/309.12; 52/508; 52/DIG. 9

(58) Field of Classification Search ..... 52/302.2, 52/309.15, 404.1, 45, 309.14, 106, 506.01, 52/506.04, 507, 783.1, DIG. 9, 745.05, 144, 52/145, 309.12, 508; 89/36.02
See application file for complete search history.

(56) References Cited

U.S. PATENT DOCUMENTS 3,308,004 A * 3/1967 Rouault ..... 428/341
3,736,715 A * 6/1973 Krumwiede ..... 52/309.11
4,122,203 A * 10/1978 Stahl ..... 428/318.4
4,147,004 A * 4/1979 Day et al. ..... 52/309.9
4,288,962 A * 9/1981 Kavanaugh ..... 52/742.13
5,724,783 A * 3/1998 Mandish ..... 52/745.05
5,729,936 A * 3/1998 Maxwell ..... 52/220.2
5,758,463 A * 6/1998 Mancini, Jr. ..... 52/309.12
5,768,841 A 6/1998 Swartz et al.
5,819,469 A * 10/1998 Hsu ..... 47/39

(Continued)

OTHER PUBLICATIONS

Young, Lee W. (Authorized Officer of PCT/ISA/US), PCT Notification of Transmittal of the International Search Report and the Written Opinion of the International Searching Authority; PCT International Search Report; and PCT Written Opinion of the International Searching Authority, mailed on Aug. 1, 2008, in International Application No. PCT/US07/80074, 9 pages total.

*Primary Examiner*—Richard E Chilcot, Jr.
*Assistant Examiner*—Chi Q Nguyen
(74) *Attorney, Agent, or Firm*—Jerry Turner Sewell

(57) ABSTRACT

A wall structure and a method for constructing the wall of a building provide protection for inhabitants of the building against ballistic projectiles impacting the wall. The wall structure includes an outer panel and an inner panel. The inner panel is a composite structure that includes a metal sheet having a first face attached to a wallboard panel. Preferably, a sheet of self-healing material is attached to a second face of the metal sheet. A cavity formed between the outer and inner panels is filled with sand or another granular material. A flexible sheet suspended in the cavity provides additional protection. Preferably, a sheet of woven para-aramid fiber such as Kevlar® brand fiber is loosely attached to the flexible sheet to provide further protection.

17 Claims, 11 Drawing Sheets

U.S. PATENT DOCUMENTS

| | | | | |
|---|---|---|---|---|
| 6,463,702 | B1 * | 10/2002 | Weaver et al. | 52/79.1 |
| 6,510,667 | B1 * | 1/2003 | Cottier et al. | 52/742.14 |
| 6,622,452 | B2 * | 9/2003 | Alvaro | 52/742.14 |
| 6,694,694 | B2 * | 2/2004 | Zeeff | 52/506.01 |
| 6,901,713 | B2 | 6/2005 | Axsom | |
| 2002/0129574 | A1 | 9/2002 | Newhouse et al. | |
| 2005/0086905 | A1 * | 4/2005 | Ralph et al. | 52/782.1 |
| 2006/0065111 | A1 | 3/2006 | Henry | |
| 2006/0248827 | A1 | 11/2006 | Meeker | |
| 2007/0224401 | A1 | 9/2007 | Telander | |

* cited by examiner

WALL STRUCTURE FOR PROTECTION FROM BALLISTIC PROJECTILES

RELATED APPLICATIONS

The present application claims the benefit of priority under 35 U.S.C. §119(e) to U.S. Provisional Application No. 60/766,286, filed on Jan. 8, 2006.

BACKGROUND OF THE INVENTION

1. Field of the Invention

The description and claims in this application related to wall structures and methods of making wall structures, which provide protection against ballistic devices such as projectiles from pistols, rifles and machine guns.

2. Description of the Related Art

The walls of conventional buildings generally do not provide significant safety from bullets shot from handguns, rifles and machine guns. In particular, although the relatively thin exterior and interior panels of a conventional building may reduce the velocity of bullets, the bullets may penetrate both panels with sufficient velocity remaining to harm or kill an occupant of the building. Fortress-like structures may be built having hardened walls of steel or reinforced concrete; however, such construction is quite expensive. Furthermore, such construction requires the time-consuming transportation of construction materials and heavy construction equipment, and then requires a considerable amount of time to erect. Thus, for example, when a military force enters an area subject to live fire from enemy forces, the military personnel must rely on existing unreinforced structures or portable structures such as tents, none of which provide adequate protection from bullets.

SUMMARY OF THE INVENTION

In view of the foregoing, a need exists for buildings which can be quickly constructed using conventional techniques and using readily transportable materials.

An aspect of an embodiment disclosed herein is a wall system comprising a lower horizontal member, an upper horizontal member, and a plurality of spaced apart vertical supports positioned between the lower horizontal member and the upper horizontal member. Each vertical support has a thickness between a respective first side and a respective second side. A first panel is mounted to the respective first sides of at least two of the vertical supports, and a second panel is mounted to the respective second sides of the at least two of the vertical supports to form a cavity bounded by the first panel and the second panel and bounded by the at least two of the vertical supports. At least one of the first panel and the second panel comprises a sheet of construction material, and a metallic sheet secured to the sheet of construction material. A granular filler material substantially fills the cavity between the lower support member and the upper support member.

In certain embodiments, the granular material comprises a stony material. For example, the stony material comprises sand in certain embodiments. In certain embodiments, a flexible sheet (e.g., a rubber sheet) is suspended from the upper support member in a position between the first panel and the second panel. The flexible sheet has a first face and a second face. A first portion of the granular filler material is positioned between the first face of the flexible sheet and the first panel, and a second portion of the granular filler material is positioned between the second face of the flexible sheet and the second panel. In particular embodiments, a sheet of woven para-aramid fiber (e.g., Kevlar®) is loosely coupled to at least one of the first face and the second face. For example, the woven sheet is secured to the flexible sheet at a plurality of spaced apart locations. In certain embodiments of the wall system, a self-sealing material is positioned on the inside of the metallic sheet to inhibit loss of the granular filler material when the metallic sheet is penetrated by a projectile.

Another aspect of an embodiment disclosed herein is a method of constructing a wall system. The method comprises erecting a plurality of vertical support members between a lower horizontal member and an upper horizontal member to form wall frame having a first side and a second side. The method also comprises mounting a first panel on a first side of the wall frame and mounting a second panel on a second side of the wall frame to form a cavity therebetween. At least one of the first panel and the second panel comprises a sheet of construction material and a sheet of metal adhered to the sheet of construction material. The method further comprises filing the cavity with a granular filler material such that the granular filler material extends from the lower horizontal member to the upper horizontal member.

In certain embodiments of the method, the granular material comprises a stony material, such as, for example, sand. In certain embodiments, the method further comprises suspending a flexible sheet (e.g., a rubber sheet) from the upper horizontal member. The flexible sheet extends from the upper horizontal member to a position proximate the lower horizontal member. In certain embodiments of the method, the flexible sheet is suspended from the upper horizontal member prior to filling the cavity with the granular filler material. In accordance with one embodiment of the method, the flexible sheet is mounted with a first portion of the granular filler material between the flexible sheet and the first panel and with a second portion of the granular filler material between the flexible sheet and the second panel. In accordance with another embodiment of the method, the first portion of granular filler material has a first volume and the second portion of granular filler material has a second volume. In accordance with one embodiment of this aspect of the method, the first volume and the second volume are substantially equal. In certain embodiments of the method, the flexible sheet has a first face and a second face, and a sheet of woven para-aramid fiber (e.g., Kevlar®) is mounted to at least one of the first face or the second face. In certain embodiments, the sheet of woven Kevlar fibers is fastened to the flexible sheet at a plurality of spaced apart locations to provide a loose coupling between the flexible sheet and the Kevlar sheet. In certain embodiments of the method, a self-sealing material is positioned on the inside of the sheet of metal to inhibit loss of the granular filler material when the metallic sheet is penetrated by a projectile.

Another aspect of an embodiment disclosed herein is a method of constructing a protective wall system. The method comprises erecting a plurality of vertical support members between a lower horizontal member and an upper horizontal member to form a wall frame having a first side and a second side. The method further comprises mounting a first panel on a first side of the wall frame and mounting a second panel on a second side of the wall frame to form a cavity therebetween. At least one of the first panel and the second panel comprises a sheet of construction material and a sheet of metal adhered to the sheet of construction material. The method further comprises filing the cavity with a granular filler material. Certain embodiments of the method include suspending a flexible sheet (e.g., a rubber sheet) within the cavity. Certain embodiments further include loosely mounting a sheet of woven para-aramid fiber (e.g., Kevlar®) to at least one side of the flexible sheet. In certain embodiments of the method, a self-sealing material is positioned on the inside of the sheet of metal to inhibit loss of the granular filler material when the metallic sheet is penetrated by a projectile.

Another aspect in accordance with embodiments disclosed herein is a wall section that comprises a lower horizontal member. At least a first vertical member and a second vertical member have respective lower ends mounted on the lower horizontal member and have respective upper ends. Each of the vertical members has a first side and a second side. An upper horizontal member is mounted on the upper end of the first vertical member and on the upper end of the second vertical member. A first panel is secured to the first side of the first vertical member and to the first side of the second vertical member. A second panel is secured to the second side of the first vertical member and to the second side of the second vertical member. The first panel and the second panel form a cavity bounded by the lower horizontal member, the upper horizontal member, the first vertical member and the second vertical member. At least one of the first panel and the second panel comprises a wallboard sheet and a thin sheet of high strength material attached to and covering at least one side of the wallboard sheet. The wall section further comprises a granular filler material that substantially fills the cavity between the lower horizontal member and the upper horizontal member. In certain embodiments, a flexible sheet is suspended within the cavity. In certain embodiments, a sheet of woven para-aramid fiber (e.g., Kevlar®) is loosely mounted to at least one side of the flexible sheet.

In certain embodiments of the wall section, the granular material comprises a stony material, such as, for example, sand. In certain embodiments of the wall section including a flexible sheet, the flexible sheet is in a plane between and generally parallel to the first panel and the second panel. The flexible sheet has a first face and a second face. A first portion of the granular filler material is positioned between the first face of the flexible sheet and the first panel, and a second portion of the granular filler material is positioned between the second face of the flexible sheet and the second panel. In certain embodiments, the wall system further comprises a sheet of woven para-aramid fiber (e.g., Kevlar®) loosely coupled to at least one of the first face and the second face of the flexible sheet. For example, the woven sheet of Kevlar fiber is secured to the flexible sheet at a plurality of spaced apart locations. In certain embodiments of the wall section, a self-sealing material is positioned on the inside of the sheet of metal to inhibit loss of the granular filler material when the metallic sheet is penetrated by a projectile.

BRIEF DESCRIPTION OF THE DRAWINGS

The foregoing aspects and other aspects of this disclosure are described in detail below in connection with the accompanying drawing figures in which.

DETAILED DESCRIPTION OF PREFERRED EMBODIMENTS

Figure 1:
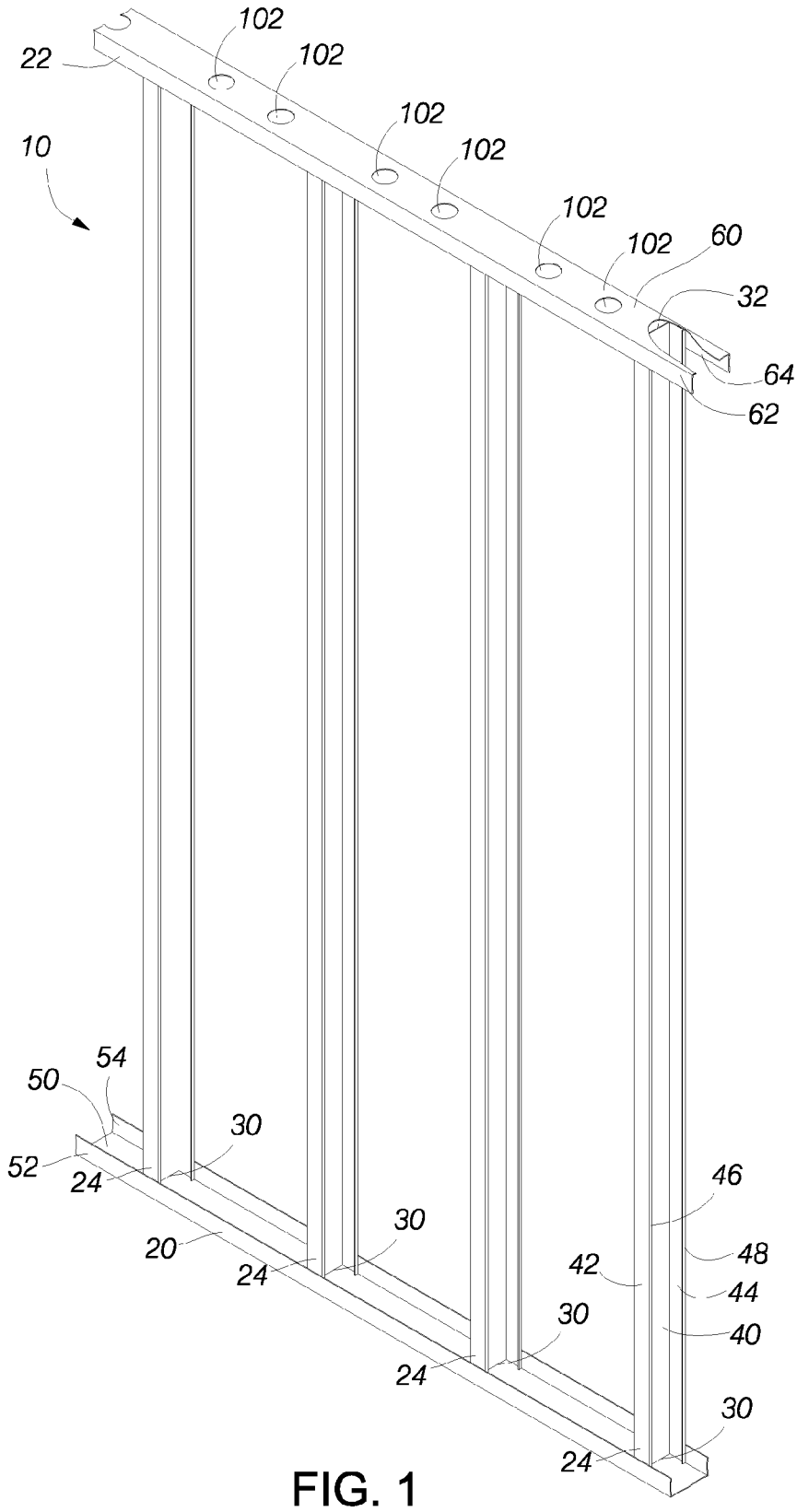
FIG. 1 is a perspective illustration of the framing of a wall section that may be used in embodiments in accordance with the disclosure herein.

FIG. 1 is a perspective illustration of a frame of a wall section 10 that may be used in embodiments in accordance with the disclosure herein. As illustrated, the wall section comprises a lower horizontal member 20. The wall section further includes an upper horizontal member 22.

The wall section further includes a plurality of vertical members 24, which may be referred to as wall studs. The vertical members have respective lower ends 30 mounted on the lower horizontal member and have respective upper ends 32 which support the upper horizontal member. The vertical members are mounted perpendicular to the horizontal member such that when the horizontal member is mounted horizontally on a foundation or other supporting surface, the vertical members are perpendicular to the supporting surface.

The lower horizontal member 20, the upper horizontal member 22 and the vertical members 24 may comprise a variety of construction materials, such as, for example, wood or metal. In the embodiments illustrated herein, the lower and upper horizontal members are metal (e.g., steel) channel sections, and the vertical members comprise metal (e.g., steel) C-sections or channel sections, which provide a combination of high strength, light weight, consistent dimensions, and fast construction. In particular, the horizontal members and the vertical members may be manufactured in a factory or at a remote location and shipped to a construction site for rapid assembly. Alternatively, entire wall sections may be prefabricated and shipped to the construction site, where the sections are interconnected before performing the steps described below.

The vertical members 24 have cross-sectional dimensions chosen in accordance with a selected wall thickness. For example, in the illustrated embodiment, the C-shaped cross section has a web 40, a first flange 42 and a second flange 44. The first and second flanges are perpendicular to the web. The two flanges have respective perpendicular lips 46 and 48, which are parallel to the web. The two flanges define a minor width of 1.5 inches, and the web defines a single major width of 3.5 inches. Thus, the dimensions of the illustrated vertical members generally correspond to the cross-sectional dimensions of a "two-by-four" construction stud. If a greater wall thickness is desired, the major width of the web may be selected to be 5.5 inches to correspond to the major width of a "two-by-six" construction stud. The minor width of the flanges may also be increased for additional strength.

In the illustrated embodiment, the lower horizontal member 20 is a lower framing track that has a structure similar to the structure of the vertical members 24. In particular, the lower horizontal member has a central web 50 and a first perpendicular flange 52 and a second perpendicular flange 54. Unlike the flanges of the vertical members 24, the flanges of the lower horizontal member do not have lips. The web of the lower horizontal member is slightly larger than the overall major width of the vertical members so that the lower ends 30 of the vertical members fit between the flanges 52 and 54. The vertical members are secured to the horizontal member by conventional interconnection devices (e.g., using screws, rivets, or other suitable fasteners (not shown)).

In the illustrated embodiment, the upper horizontal member 22 is similar to the lower horizontal member 20 and has a horizontal web 60, a first perpendicular web 62 and a second perpendicular web 64. The upper horizontal member is positioned over the upper ends 32 of the vertical members 24 between the first and second flanges and with the web resting on the upper ends. The upper horizontal member is secured to the vertical members by conventional interconnection devices (not shown).

In preferred embodiments, the vertical members 24 are spaced apart by selected distances in accordance with conventional construction techniques. For example, in the illustrated embodiment, the vertical members have a center-to-center spacing of 16 inches. In other embodiments, the vertical members have a center-to-center spacing of 24 inches.

The lengths of the vertical members 24 are selected in accordance with a desired height of the wall section. For example, when the desired height of a wall section is eight feet, the lengths of the vertical members may be slightly less than eight feet so that the combined length of a vertical member and the thicknesses of the web of lower horizontal member 20 and the web of the upper horizontal member 22 are approximately eight feet.

Figure 2:
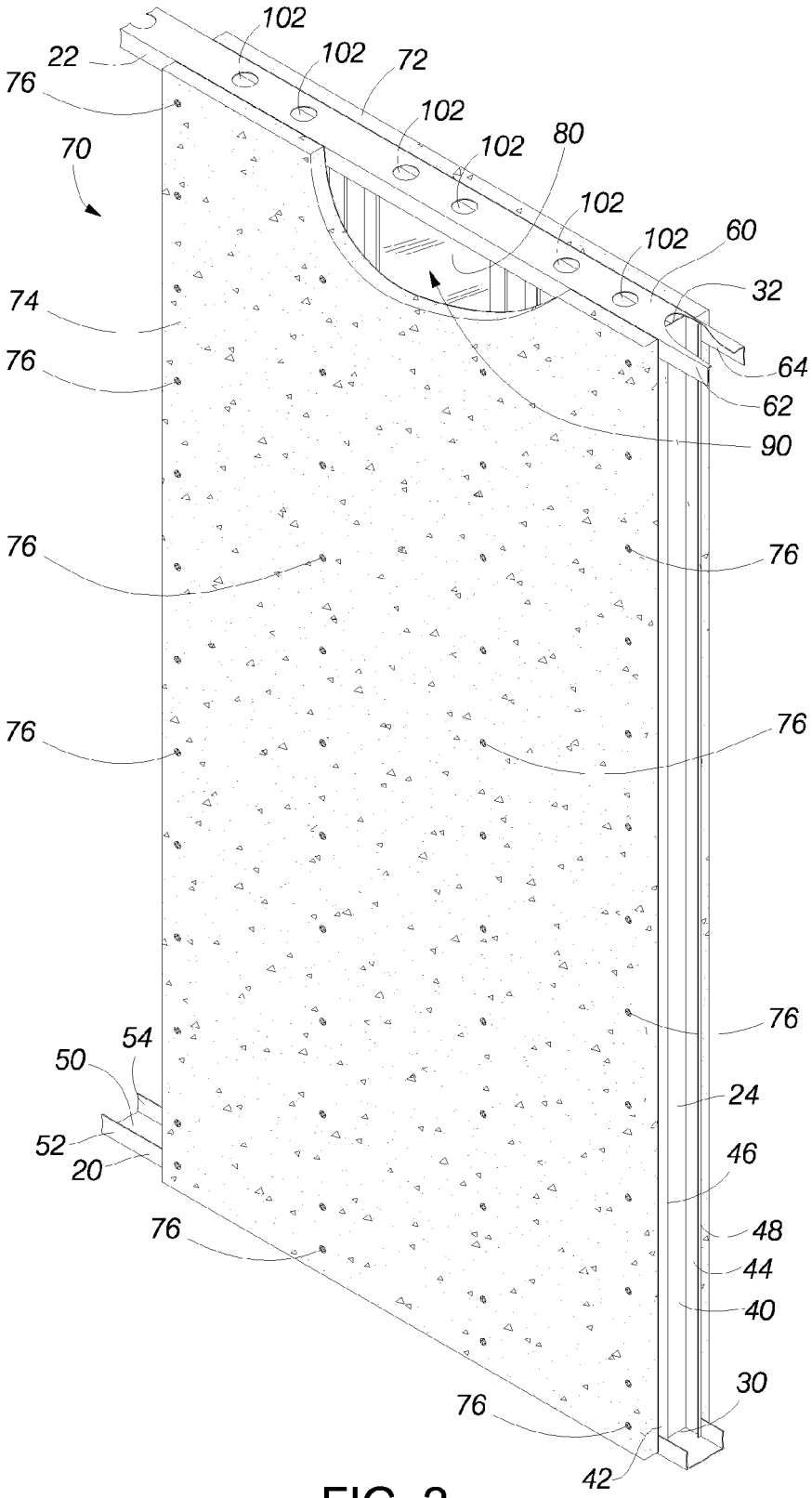
FIG. 2 is a perspective illustration of an assembled wall section in accordance with an embodiment disclosed herein, showing an outer wall panel and an inner wall panel with a portion of the inner wall panel illustrated in partial broken section to show the cavity formed between the inner wall panel and the outer wall panel.

As illustrated by an assembled wall structure 70 in FIG. 2, four adjacent vertical support members 24 of the skeletal framing structure 10 have an overall width between the centerlines of the outermost support members of 48 inches in order to support a first 4-foot by 8-foot outer wall panel 72 mounted to the flanges on one side of the vertical members and to support a second 4-foot by 8-foot inner wall panel 74 mounted to the flanges on the opposite side of the vertical members. For example, the panels are advantageously mounted to the vertical members by a plurality of suitable fasteners 76, such as, for example, self-tapping screws or nails. The panels are also mounted to the flanges of the lower horizontal member 20 and the upper horizontal member 22 in a similar manner.

Figure 3:
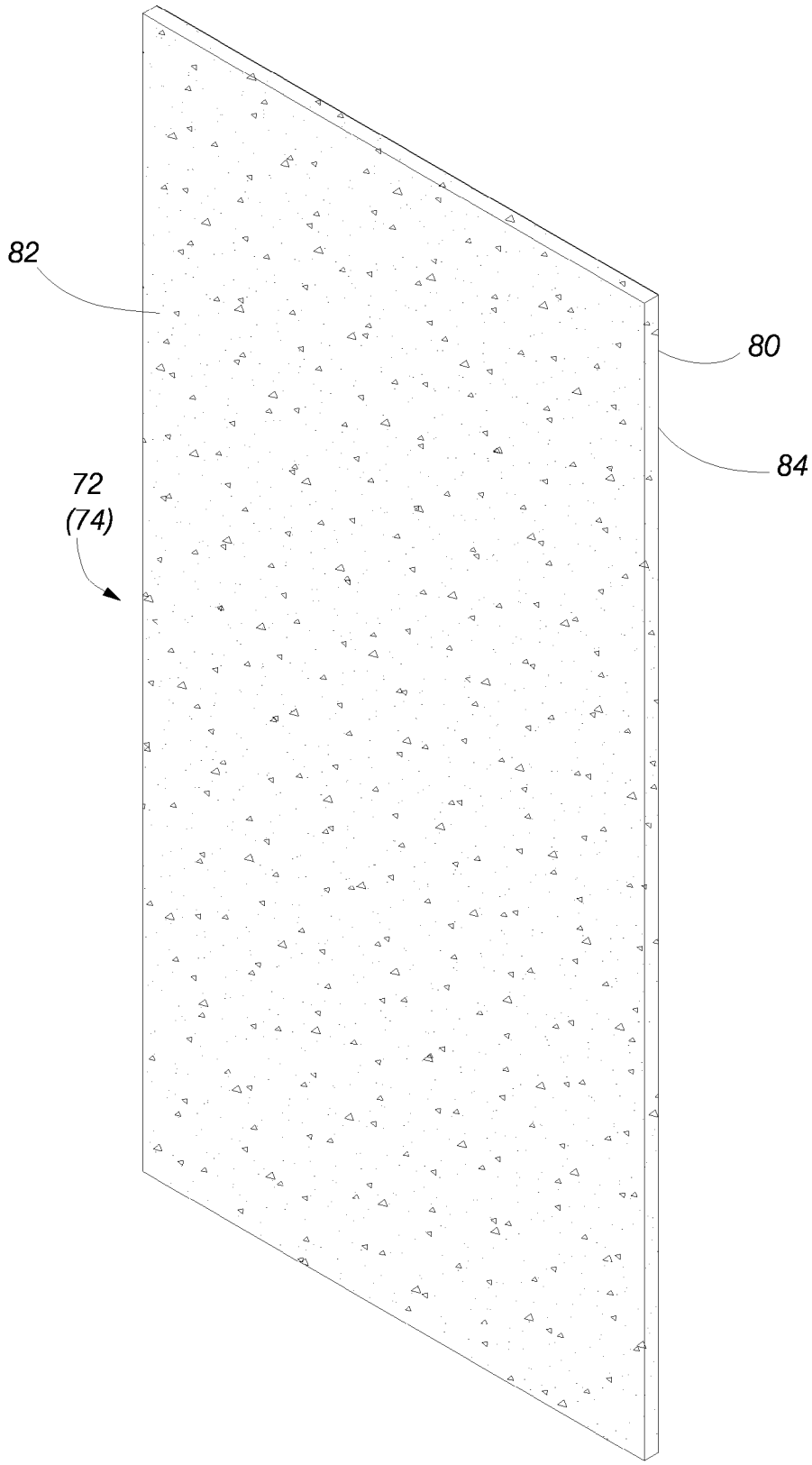
FIG. 3 is a perspective view of a shear panel used in certain embodiments of the assembled wall section of FIG. 2.
Figure 4:
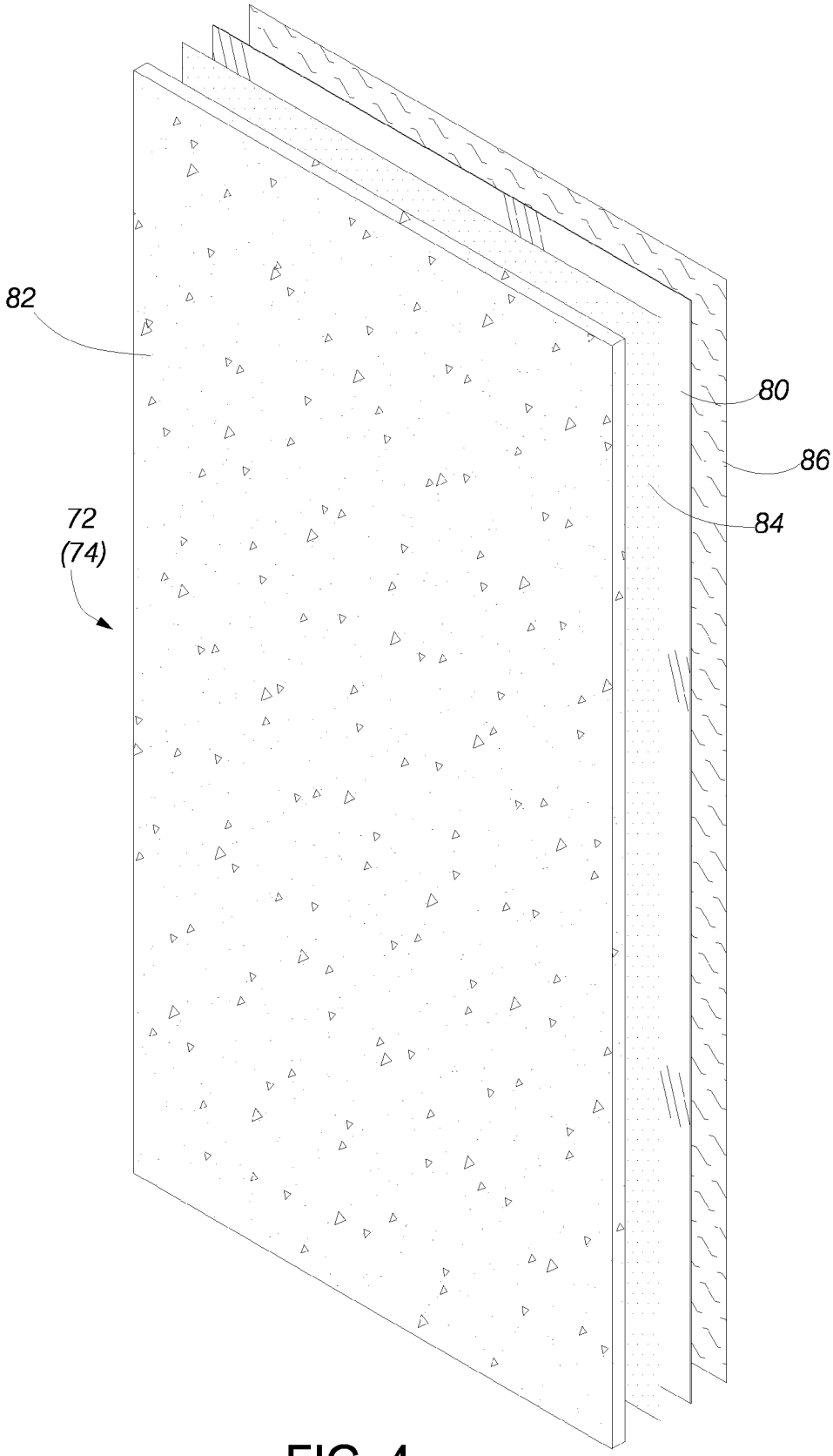
FIG. 4 is an exploded perspective view of the shear panel of FIG. 3.

In the illustrated embodiment, the outer wall panel 72 and the inner wall panel 74 are composite structures, which are illustrated in FIGS. 3 and 4. The assembled composite wall panel 72 or 74 is illustrated in FIG. 3. An exploded view of the wall panel is illustrated in FIG. 4. The structures of the outer wall panel and the inner wall panel are similar, so a single set of illustrations illustrates both types of panels.

Each of the two panels 72 and 74 comprises a wallboard structure, such as, for example, the composite wallboard structure disclosed in U.S. Pat. No. 5,768,841 to Swartz et al., which is incorporated herein by reference. As shown in the exploded view in FIG. 4, each of the outer wall panel and the inner wall panel comprises a thin metal sheet 80 attached to a wallboard panel 82. For example, in one advantageous embodiment, the metal sheet comprises steel having a thickness in a range of 0.015 inch to 0.060 inch, and the wallboard panel has a thickness in a range of 0.5 inch to 0.75 inch. It should be understood that the thickness of the metal sheet can be greater or less than the foregoing range. Similarly, the thickness of the wallboard panel can also be outside the foregoing range.

In certain embodiments, the wallboard panel 82 of the inner wall panel 74 comprises gypsum board. In certain embodiments, the wallboard panel 82 of the outer wall panel 72 may also be a gypsum board. In alternative embodiments, the wallboard panel of the outer wall panel comprises a non-combustible material such as Durock® brand underlayment available from USG Corporation headquartered in Chicago, Ill.; PermaBase® brand cement board available from National Gypsum Company headquartered in Charlotte, N.C.; and Hardiebacker 500® brand cement backerboard available from James Hardie Building Products in Mission Viejo, Calif. Other cement boards and boards comprising other non-combustible materials may also be used.

As illustrated in FIG. 4, the metal sheet 80 is secured to the wallboard panel 82 by a suitable adhesive 84 (for example, glue or epoxy) as described in U.S. Pat. No. 5,768,841 to form a composite structure. The adhesive is applied to the mating face of the metal sheet or the mating face of the wallboard panel or to the mating faces of both. The metal sheet and the wallboard panel are held together by suitable pressure until the adhesive sets.

As further illustrated in the exploded view of FIG. 4, in particularly preferred embodiments, a flexible sheet 86 of self-sealing material is attached to a surface of the metal sheets 80 (e.g., the exposed surface opposite the surface secured to the wallboard panel 82) of the two wall panels 72, 74. In particular embodiments, the sheet of self-sealing material advantageously comprises a butyl rubber material such as, for example, the material used in self-sealing vehicle tires. The sheet of self-sealing material is attached to the metal sheet by a suitable adhesive or other suitable attachment material. When the two wall panels 72, 74 are placed on the wall framing to form the assembled wall structure 70, the sheets of self-sealing material are positioned against the vertical members 24, the lower horizontal member 20 and the upper horizontal member 22.

When fastened to the framing structure 10, the outer wall panel 72 and the inner wall panel 74 assist the assembled wall structure 70 in resisting in-plane and shear loading stresses. In addition, the two panels provide the advantages described below in protecting building occupants from bullets and other ballistic projectiles.

As shown in FIG. 2, the outer wall panel 72 and the inner wall panel 74 and each adjacent pair of vertical support members 24 define a cavity 90 between the lower horizontal member 20 and the upper horizontal member 22. In conventional construction, such a cavity might be filed with fiberglass or other insulation to reduce the transfer of thermal energy into and out of the structure formed by a plurality of similar wall sections.

Figure 5:
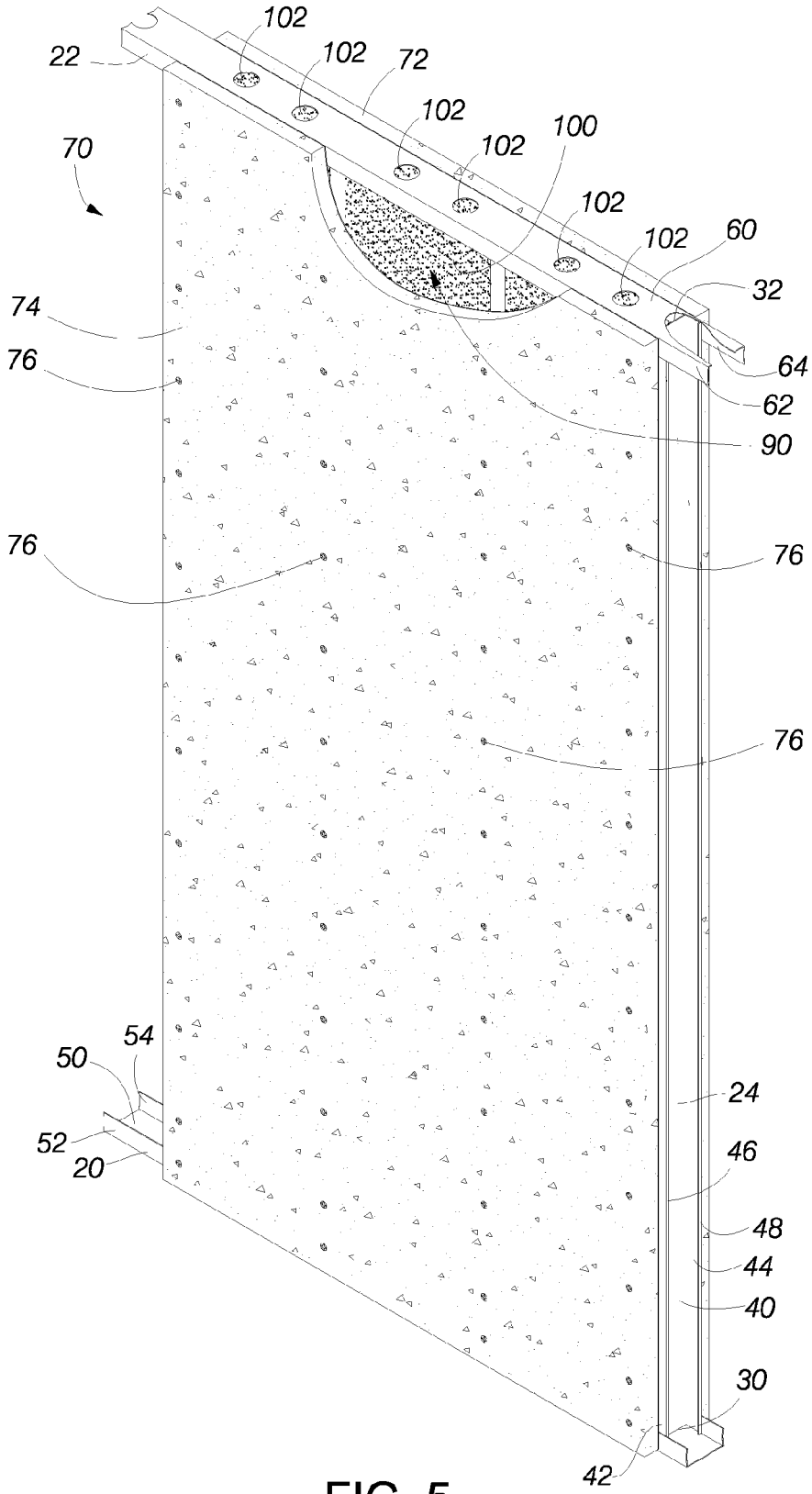
FIG. 5 is a perspective illustration of the assembled wall section of FIG. 2, with a portion of the wall section illustrated in partial broken section to show a granular material filling the cavity between the inner wall panel and the outer wall panel.

As illustrated in FIG. 5, after the wall section 70 is erected and the outer wall panel 72 and the inner wall panel 74 are securely attached, the cavity 90 thus formed between each pair of adjacent vertical support members 24 is filled with a granular material 100. In preferred embodiments, the granular material is a stony material. In particularly preferred embodiments, the granular material is sand, which is readily available throughout the world and is quite plentiful in the Middle Eastern countries. Furthermore, sand is easy to manipulate so that it can be added to the cavity through a plurality of holes 102 formed in the upper horizontal member 22. The grains of sand tend to evenly fill the cavity and to pack into a dense mass. Any incomplete filling of the cavity proximate to the upper horizontal support member is acceptable since the occupants of a structure incorporating the wall section are not likely to be at the level of the top of the wall section.

The embodiment of FIG. 5 provides a first level of protection from ballistic projectiles in comparison to conventional construction. In particular, the densely packed sand 100 (or other granular filler material) between the outer wall panel 72 and the inner wall panel 74 causes a significant reduction in the velocity of a ballistic projectile that penetrates the outer wall panel. For some projectiles, the residual velocity of the projectile after passing through the sand may be insufficient to penetrate the metal sheet 80 of the inner wall panel. Even if the projectile penetrates the metal sheet, the combined slowing effect of the sand and the metal sheet may be sufficient to reduce the extent of injury upon a person hit by the projectile. As discussed above, in preferred embodiments, the sheet 86 of self-healing material is positioned on the metal sheets of the two wall panels as shown in FIG. 4. Thus, an opening caused during the passage of a projectile penetrating the outer wall panel will be substantially closed after the passage of the projectile to prevent or reduce the leakage of the sand from the cavity 90. Similarly, the sheet of self-healing material on the inner wall panel will prevent or reduce the leakage of sand through an opening formed by the passage of a projectile through the inner wall panel.

Figure 6:
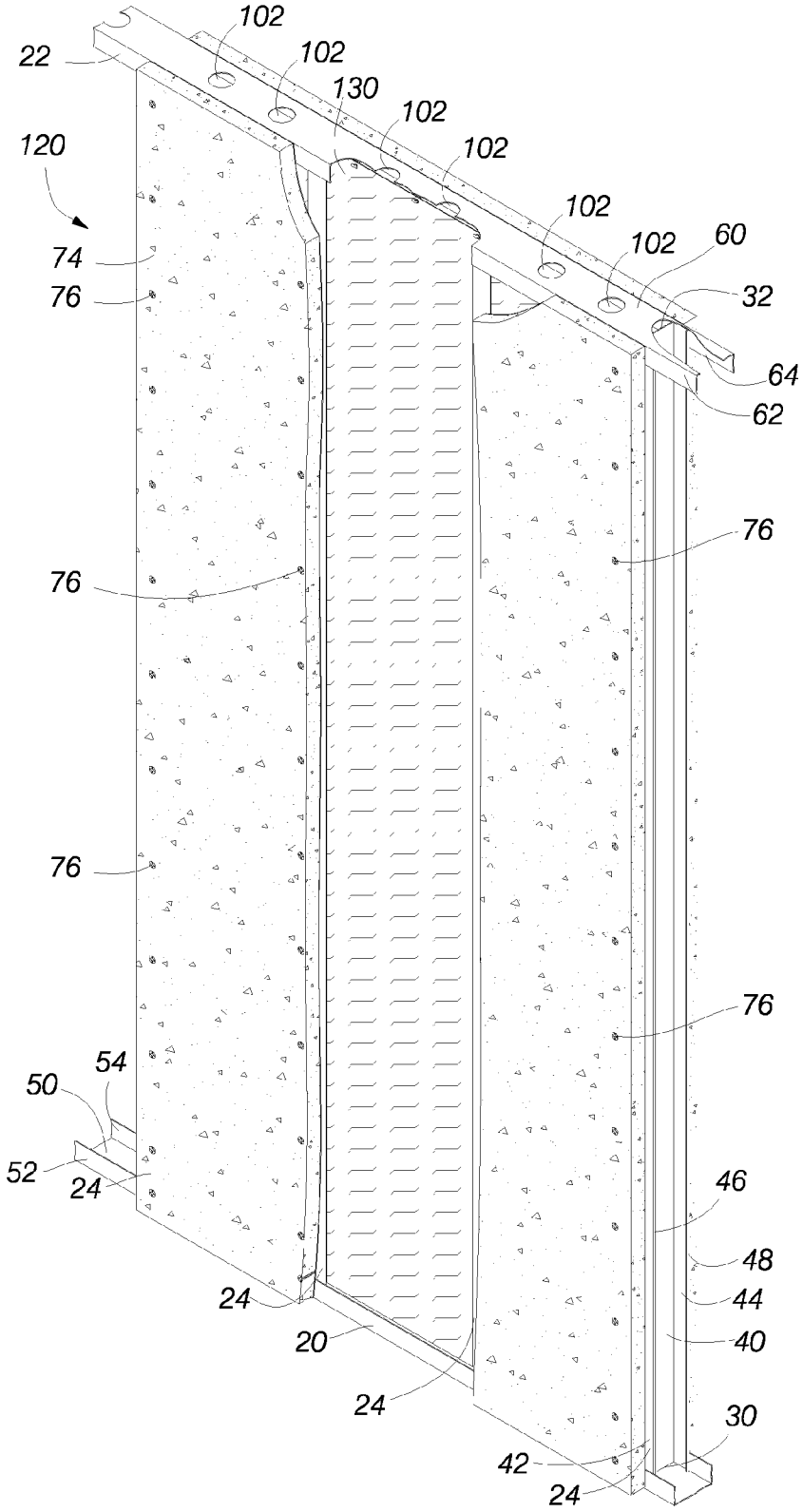
FIG. 6 is a perspective illustration of an assembled wall section in accordance with a further embodiment disclosed herein, showing an outer wall panel and an inner wall panel with a portion of the inner wall panel illustrated in partial broken section to show a flexible sheet suspended in the cavity between the inner wall panel and the outer wall panel prior to adding the granular filling material.
Figure 7:
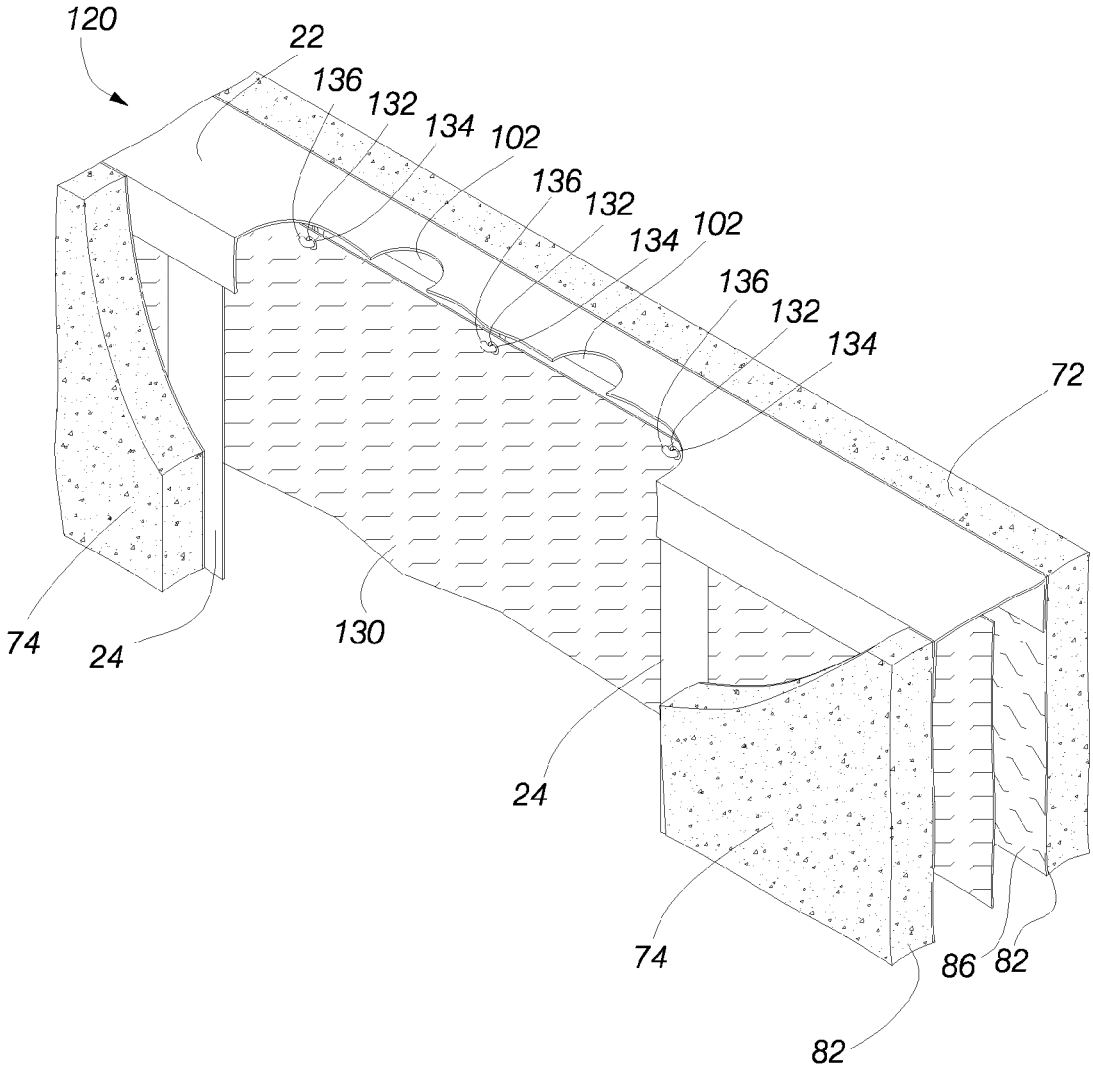
FIG. 7 is an enlarged perspective view of the top portion of the wall section of FIG. 6 to show the suspended flexible sheet in more detail.
Figure 8:
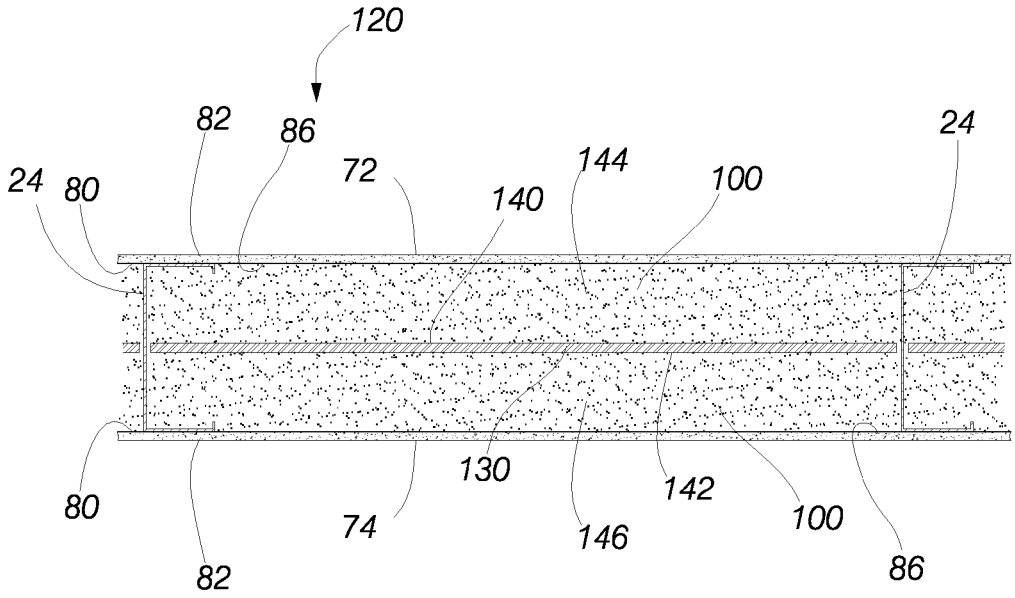
FIG. 8 is a cross-sectional illustration of a wall section in accordance with the embodiment of FIGS. 6 and 7, further showing the granular filling material in the first and second volumes of the cavity formed between the flexible sheet and the inner and outer wall panels.

FIGS. 6, 7 and 8 illustrate an embodiment of an assembled wall section 120 that provides an additional level of ballistic protection. FIGS. 6 and 7 illustrate the wall section prior to adding the granular filling material (e.g., sand) 100. FIG. 8 illustrates the wall section after adding the granular filing material. In FIG. 6, a portion of the inner wall is broken away to show a flexible sheet 130. The flexible sheet advantageously comprises a suitable thickness of rubber, such as, for example, rubber manufactured from recycled tires. As shown in FIG. 7, the flexible sheet has a plurality of holes 132 formed proximate to an upper end. Preferably, each of the holes is reinforced with a respective grommet 134.

As illustrated in the enlarged perspective view in FIG. 7, the flexible sheet 130 is suspended from the upper horizontal member 22 via a plurality of hooks 136, which pass through the grommets 134. Preferably, the hooks are positioned approximately at the center of the web 60 of upper horizontal member so that the flexible sheet is suspended in the cavity 90 between the outer wall panel 72 and the inner wall panel 74. For example, in the embodiment illustrated in FIG. 7, the flexible sheet is positioned approximately in the middle of the cavity.

The flexible sheet 130 has a length that is selected to so that the flexible sheet spans substantially the entire distance from the upper horizontal member 22 to the lower horizontal member 20. The flexible sheet has a width selected to span the distance between adjacent vertical members 24. For example, in a wall section using metal studs having a center-to-center spacing of 16 inches, the flexible sheet has a width of slightly less than 16 inches. If wooden 2 by 4 studs are used, the flexible sheet has a width of approximate 14.5 inches to accommodate the thickness of the studs. In a wall section using metal studs having a center-to-center spacing of 24 inches, the flexible sheet has a width of slightly less than 24 inches.

Preferably, the flexible sheet 130 is suspended in the cavity 90 before adding the outer wall panel 72, the inner wall panel 74 and the sand (or other granular filler material) 100. As illustrated in the enlarged cross-sectional view in FIG. 8, the flexible sheet has a first face 140 and a second face 142. The first face is closer to the outer wall panel, and the second face is closer to the inner wall panel. The flexible sheet divides the cavity into a first volume 144 and a second volume 146. The first volume is formed between the first face of the flexible sheet and the outer wall panel. The second volume is formed between the second face of the flexible sheet and the inner wall panel. The first volume and the second volume are filled with the sand so that a first portion of the sand is between the flexible sheet and the outer wall panel and a second portion of the sand is between the flexible sheet and the inner wall. In the illustrated embodiment, the two volumes of sand are approximately the same; however, in other embodiments, one volume may be greater than the other volume in accordance with the placement of the flexible sheet in the cavity.

In the embodiment of FIGS. 6, 7 and 8, the sand (or other granular filler material) 100 is added in a controlled manner so that the levels of the sand in the two volumes 144 and 146 increase at substantially the same rate so that the flexible sheet 130 is not significantly displaced from an initial vertical orientation beneath the upper horizontal member.

The embodiment of FIGS. 6, 7 and 8 provides a second level of protection from ballistic projectiles. In particular, in addition to the velocity retarding effect provided by the densely packed sand (or other granular filler material) 100, the flexible sheet 130 causes a further reduction in the velocity of a ballistic projectile. Although the flexible sheet has sand on both sides, the flexible sheet has a tendency to yield to the force of an impinging projectile. The yielding effect of the flexible sheet will further reduce the velocity of the projectile. Furthermore, the yielding movement of the flexible sheet may deflect the projectile such that the projectile passes through the flexible sheet and the sand at an angle that differs from the incident angle. Hence, the deflection may increase the length of the path of the projectile through the sand, thus providing an additional slowing effect. The combination of the metal sheets 80 of the two wall panels 72 and 74, the sand in the first volume 144, the flexible sheet, and the sand in the second volume 146 increases the probability that a ballistic projectile will be slowed sufficiently to reduce the extent of injury upon a person hit by the projectile. As discussed above, in preferred embodiments, the sheets 86 of self-healing material on the two wall panels assist in reducing or eliminating leakage through openings caused by passages of projectiles through the wall panels.

Figure 9:
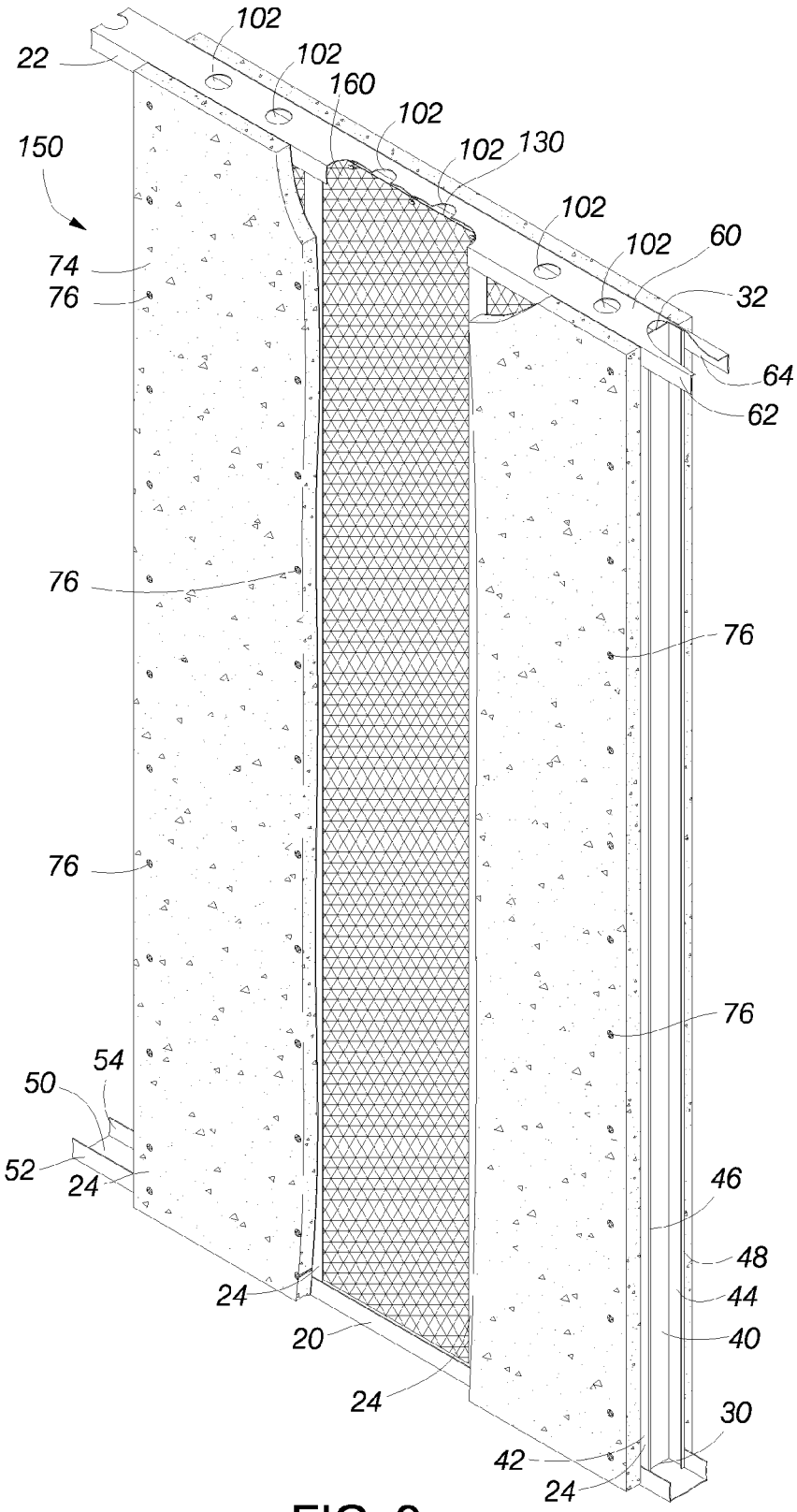
FIG. 9 is a perspective illustration of an assembled wall section in accordance with a further embodiment disclosed herein, showing a sheet of woven, high-tensile strength fiber loosely attached to the flexible sheet of FIGS. 6-8, prior to adding the granular filling material.
Figure 10:
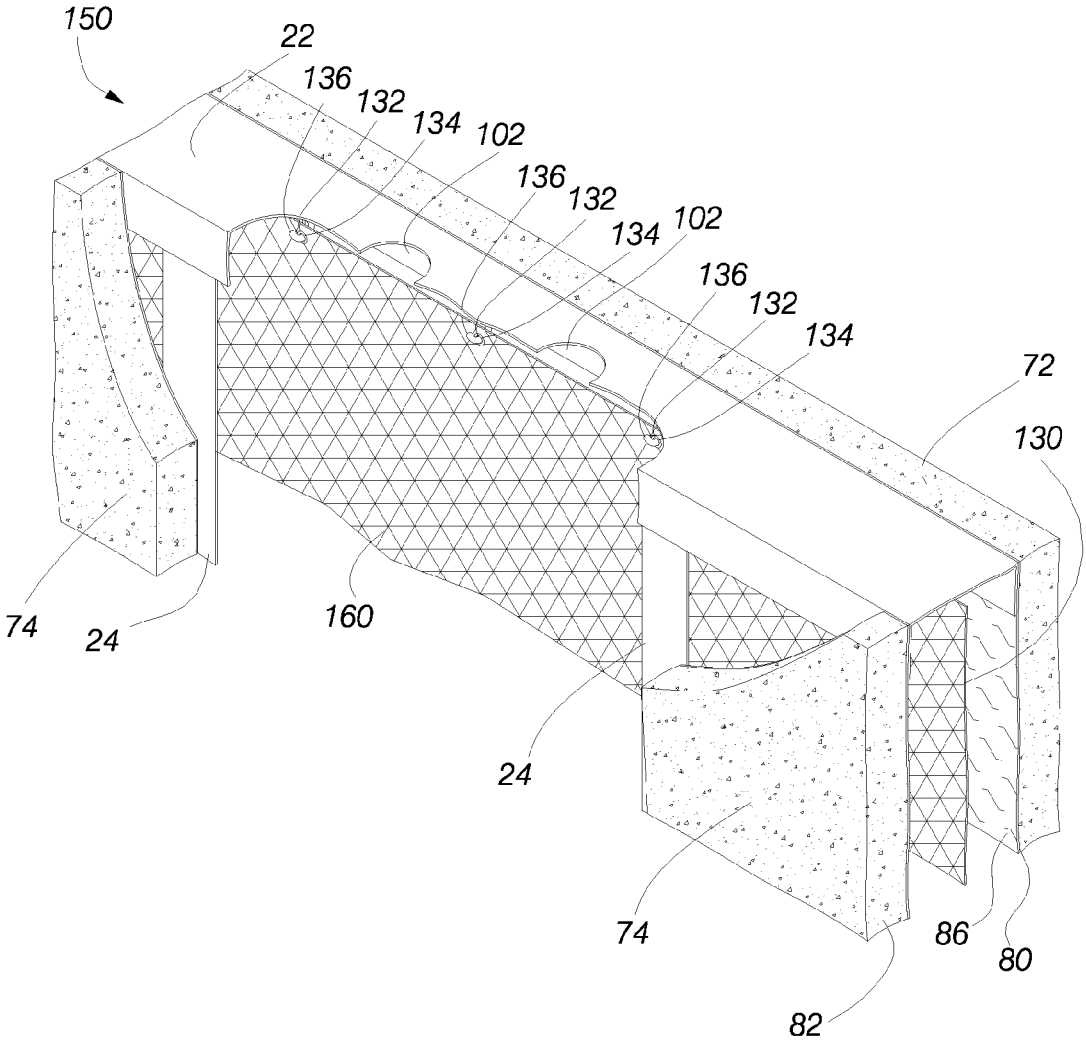
FIG. 10 is an enlarged perspective view of the top portion of the wall section of FIG. 9 to show the sheet of woven fiber in more detail.
Figure 11:
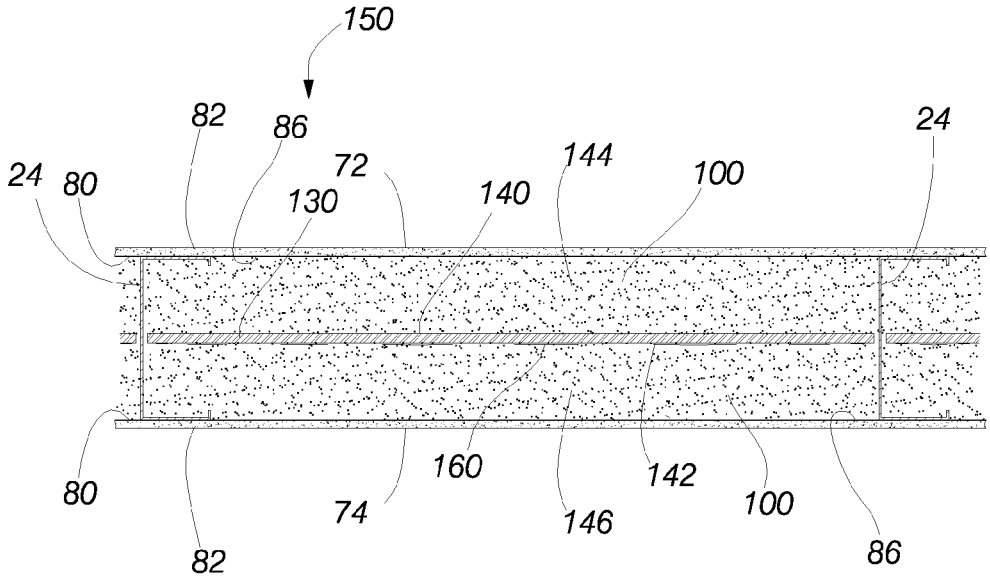
FIG. 11 is a cross-sectional illustration of a wall section in accordance with the embodiment of FIGS. 9 and 10, further showing the granular filling material in the first volume of the cavity formed between the flexible sheet and the outer wall panel and the second volume of the cavity formed between the sheet of woven fiber and the inner wall panel.

FIGS. 9, 10 and 11 illustrate a further improvement in an assembled wall section 150 that provides an additional level of protection. The assembled wall section in FIGS. 9-11 is similar to the embodiment of FIGS. 6 and 7 with the addition of a sheet 160 of woven, high tensile strength fiber loosely coupled to the second face 142 of the flexible sheet 130. The woven sheet is shown in the perspective view of FIG. 9 and in the enlarged cross-sectional view of FIG. 10. In a preferred embodiment, the woven fiber sheet comprises a para-aramid fiber such as KEVLAR® fiber manufactured by E.I. du Pont de Nemours and Company or a similar material.

The woven fiber sheet 160 is attached to the second face 142 of the flexible sheet 130 at a plurality of widely spaced spots using a suitable adhesive. Thus, the woven fiber sheet hangs parallel to the flexible sheet. In the illustrated embodiment, the woven fiber sheet is mounted to the second face 142 of the flexible sheet so that a ballistic projectile passes through the flexible sheet before encountering the woven fiber sheet. Since the woven fiber sheet is loosely coupled to the flexible sheet, the fibers of the woven fiber sheet are able to move freely when impacted by the ballistic projectile, thus increasing the likelihood that the woven fiber sheet will capture the projectile rather than allowing the projectile to pass through the woven fiber sheet. Even if the projectile does pass through the woven fiber sheet, the velocity of the projectile will be further reduced, thus increasing the probability that the projectile will be stopped or sufficiently slowed by the combination of the sand in the second volume 146 and the metal sheet 80 of the inner wall panel 74 so that the projectile will not harm a person protected by the wall section 150. As discussed above, in preferred embodiments, the sheets 86 of self-healing material on the two wall panels assist in reducing or eliminating leakage through openings caused by passages of projectiles through the wall panels.

As illustrated in the foregoing embodiments, the walls of a structure can be erected easily and quickly at a construction site. The metal construction materials, the panels and the flexible sheet can be easily transported to a construction site and installed as described above. Alternatively, the wall sections, including the flexible sheet if desired, can be prefabricated and delivered to a construction site ready to be interconnected. After the walls are erected in either manner, the sand is added to the cavities of the wall sections. The sand to fill the cavities can be found at many construction sites or can be readily hauled to a construction site.

One skilled in art will appreciate that the foregoing embodiments are illustrative of the present invention. The present invention can be advantageously incorporated into alternative embodiments while remaining within the spirit and scope of the present invention, as defined by the appended claims.

We claim:

1. A wall system comprising:

a lower horizontal member;

an upper horizontal member;

a plurality of spaced apart vertical supports positioned between the lower horizontal member and the upper horizontal member, each vertical support having a thickness between a respective first side and a respective second a first panel mounted to the respective first sides of at least two of the vertical supports and a second panel mounted to the respective second sides of the at least two of the vertical supports to form a cavity bounded by the first panel and the second panel and bounded by the at least two of the vertical supports, at least one of the first panel and the second panel comprising:

a sheet of construction material; and a metallic sheet secured to the sheet of construction material;

a flexible sheet suspended from the upper horizontal member in a position between the first panel and the second panel; and a loose, dry granular filler material that substantially fills the cavity between the lower horizontal member and the upper horizontal member.

2. The wall system of claim 1, wherein the granular material comprises a stony material.

3. The wall system as defined in claim 2, wherein the stony material comprises sand.

4. The wall system as defined in claim 1, wherein the flexible sheet comprises rubber.

5. The wall system as defined in claim 1, wherein the flexible sheet has a first face and a second face, and wherein a first portion of the granular filler material is positioned between the first face of the flexible sheet and the first panel and a second portion of the granular filler material is positioned between the second face of the flexible sheet and the second panel.

6. The wall system as defined in claim 1, wherein the flexible sheet has a first face and a second face, and wherein the wall system further comprises at least one sheet of woven para-aramid fiber loosely coupled to at least one of the first face and the second face.

7. The wall system as defined in claim 6, wherein the sheet of woven para-aramid fiber is secured to the flexible sheet at a plurality of spaced apart locations.

8. A wall system comprising:

a lower horizontal member;

an upper horizontal member;

a plurality of spaced apart vertical supports positioned between the lower horizontal member and the upper horizontal member, each vertical support having a thickness between a respective first side and a respective second side;

a first panel mounted to the respective first sides of at least two of the vertical supports and a second panel mounted to the respective second sides of the at least two of the vertical supports to form a cavity bounded by the first panel and the second panel and bounded by the at least two of the vertical supports, at least one of the first panel and the second panel comprising:

a sheet of construction material; and a metallic sheet secured to the sheet of construction material, wherein:

the metallic sheet comprises a first face and a second face;

the first face of the metallic sheet is secured to the sheet of construction material; and a sheet of self-healing material is positioned on the second face of the metallic sheet;

and a loose, dry granular filler material that substantially fills the cavity between the lower horizontal member and the upper horizontal member.

9. A wall section comprising:

a lower horizontal member;

at least a first vertical member and a second vertical member, each vertical member comprising:

a lower end mounted on the lower horizontal member;

an upper end;

a first side; and a second side;

an upper horizontal member mounted on the upper end of the first vertical member and the upper end of the second vertical member;

a first panel secured to the first side of the first vertical member and to the first side of the second vertical member, and a second panel secured to the second side of the first vertical member and to the second side of the second vertical member, the first panel and the second panel forming a cavity bounded by the lower horizontal member, the upper horizontal member, the first vertical member and the second vertical member, at least one of the first panel and the second panel comprising:

a wallboard sheet; and a thin sheet of high-strength material attached to and covering at least one side of the wallboard sheet;

a flexible sheet having an upper end suspended proximate the upper horizontal member, the flexible sheet being in a plane between and generally parallel to the first panel and the second panel; and a loose, dry granular filler material that substantially fills the cavity between the lower horizontal member and the upper horizontal member.

10. The wall section as defined in claim 9, wherein the granular material comprises a stony material.

11. The wall system as defined in claim 10, wherein the stony material comprises sand.

12. The wall section as defined in claim 9, wherein the flexible sheet comprises rubber.

13. The wall section as defined in claim 9, wherein:

the flexible sheet has a first side and a second side;

a first portion of the granular filler material is positioned between the first side of the flexible sheet and the first panel; and a second portion of the granular filler material is positioned between the second side of the flexible sheet and the second panel.

14. The wall section as defined in claim 9, wherein:

the flexible sheet has a first face and a second face; and the wall system further comprises at least one sheet of woven para-aramid fiber loosely coupled to at least one of the first face and the second face of the flexible sheet.

15. The wall section as defined in claim 14, wherein the sheet of woven para-aramid fiber is secured to the flexible sheet at a plurality of spaced apart locations.

16. The wall section as defined in claim 9, wherein the sheet of high-strength material comprises steel.

17. A wall section comprising:

a lower horizontal member;

at least a first vertical member and a second vertical member, each vertical member comprising:

a lower end mounted on the lower horizontal member;

an upper end;

a first side; and a second side;

an upper horizontal member mounted on the upper end of the first vertical member and the upper end of the second vertical member;

a first panel secured to the first side of the first vertical member and to the first side of the second vertical member, and a second panel secured to the second side of the first vertical member and to the second side of the second vertical member, the first panel and the second panel forming a cavity bounded by the lower horizontal member, the upper horizontal member, the first vertical member and the second vertical member, at least one of the first panel and the second panel comprising:

a wallboard sheet;

a thin sheet of high-strength material having a first face attached to and covering at least one side of the wallboard sheet and having a second face; and a sheet of self-healing material attached to the second face of the sheet of high-strength material;

and a loose, dry granular filler material that substantially fills the cavity between the lower horizontal member and the upper horizontal member.

* * * * *